US007088060B2

(12) United States Patent
Nakazato

(10) Patent No.: US 7,088,060 B2
(45) Date of Patent: Aug. 8, 2006

(54) ELECTRON TUBE FOR COMMUNICATION

(75) Inventor: Yoshio Nakazato, Kanagawa (JP)

(73) Assignee: NEC Microwave Tube, Inc. (JP)

( * ) Notice: Subject to any disclaimer, the term of this patent is extended or adjusted under 35 U.S.C. 154(b) by 0 days.

(21) Appl. No.: 10/701,287

(22) Filed: Nov. 4, 2003

(65) Prior Publication Data

US 2004/0100197 A1 May 27, 2004

(30) Foreign Application Priority Data

Nov. 11, 2002 (JP) ..... 2002-326822

(51) Int. Cl.
*H05H 15/00* (2006.01)
*H01P 1/20* (2006.01)
*H05P 6/70* (2006.01)

(52) U.S. Cl. ..... 315/503; 315/502; 315/500; 333/202; 333/208; 219/690

(58) Field of Classification Search ..... 315/500–507, 315/39, 39.3, 39.51, 39.53; 333/202, 208, 333/212, 227; 219/690
See application file for complete search history.

(56) References Cited

U.S. PATENT DOCUMENTS 4,138,625 A * 2/1979 Koyama et al. ..... 315/3.5
4,496,876 A * 1/1985 Young ..... 315/4
5,125,110 A * 6/1992 Nusair ..... 455/327
5,469,024 A 11/1995 Kirshner et al. ..... 315/5.39
6,259,207 B1 * 7/2001 Kirshner ..... 315/39
6,285,267 B1 * 9/2001 Hauth et al. ..... 333/210
2002/0097116 A1 * 7/2002 Mack et al. ..... 333/208
2003/0080828 A1 * 5/2003 Chambelin et al. ..... 333/126

FOREIGN PATENT DOCUMENTS

JP 05243813 9/1993
JP 06-020617 1/1994
JP 07-058543 3/1995

OTHER PUBLICATIONS

Untranslated Office Action issued by the French Patent Office on Jul. 25, 2005 in connection with corresponding application No. 035080800 DU Jul. 11, 2003.

Derwent Publications Ltd. –XP–002335045 nad JP 05 243813 –Sep. 21, 1993.

* cited by examiner

*Primary Examiner*—Tuyet Thi Vo
(74) *Attorney, Agent, or Firm*—Ostrolenk, Faber, Gerb & Soffen, LLP

(57) ABSTRACT

An electron tube for communication is provided with an output waveguide that is directly coupled to an outlet port of a RF (Radio Frequency) wave signal, and at least one of a low-pass filter, a high-pass filter, and a band-pass filter is included inside the output waveguide.

8 Claims, 6 Drawing Sheets

ELECTRON TUBE FOR COMMUNICATION

BACKGROUND OF THE INVENTION

1. Field of the Invention

The present invention relates to an electron tube for communication such as a traveling-wave tube or klystron that is used in communication devices.

2. Description of the Related Art

An electron tube for communication such as a traveling-wave tube or klystron is a RF (Radio-Frequency) device for amplifying or oscillating microwaves by means of the interaction between an electron beam that is emitted from an electron gun and a RF circuit. As shown in FIG. 1, an electron tube for communication is a construction that includes, for example: electron gun 3 for emitting electron beam 2, RF circuit 4 for bringing about interaction between a RF signal (microwave) and electron beam 2 that is emitted from electron gun 3, collector 5 for capturing electron beam 2 that is passed from RF circuit 4, and anode electrode 6 for guiding electron beam 2 that has been emitted from electron gun 3 into RF circuit 4. As an example of an electron tube for communication, FIG. 1 shows the construction of a traveling-wave tube.

Electron beam 2 that has been emitted from electron gun 3 is guided into RF circuit 4 by anode electrode 6 and travels inside RF circuit 4 while interacting with a RF signal that has been received as input by RF circuit 4. The electron beam that is supplied as output from RF circuit 4 is received by collector 5, and captured by a collector electrode that is provided in collector 5. The RF signal that is amplified by the interaction with electron beam 2 is then supplied as output from RF circuit 4.

As shown in FIG. 2, inside RF circuit 4 of the traveling-wave tube, a RF signal is received as input from input coaxial unit 7, and following amplification, the RF signal is supplied as output by way of output coaxial line 8 to output waveguide 9 that is provided on the side wall of traveling-wave tube 1.

Output waveguide 9 is directly coupled to the collection port of the RF signal, and output coaxial line 8 is secured to a prescribed position of the sealed end side of output waveguide 9 by means of ceramic window 10 for vacuum sealing the interior of RF circuit 4.

Flange 11 is provided for connection with other waveguides at the end of output waveguide 9 that is opposite the sealed end, and, for example, isolator 20 that is constituted by a waveguide, low-pass filter 30, and high-pass filter 40 are attached as shown in FIG. 3. The RF signal that has been irradiated into output waveguide 9 from traveling-wave tube 1, having passed through these attachments to eliminate noise that is outside the bandwidth, i.e., frequency components that are not required by the system, is radiated from a transmission antenna (not shown in the figure). The configuration that is shown in FIG. 3 is the construction disclosed in Patent Document 1 (Japanese Patent Laid-Open Publication No. 58543/1995).

To allow installation on, for example, artificial satellites or aircraft, communication devices that are provided with an electron tube for communication such as a traveling-wave tube or klystron must be compact and lightweight.

In Patent Document 1, a construction is proposed for reducing the size and weight of the overall antenna device that includes a traveling-wave tube in which a primary radiator that is positioned at the focal point of a reflecting mirror is supported and secured by, for example, the above-described isolator that is composed of a waveguide, low-pass filter, and high-pass filter.

However, reducing the size and weight has been problematic because the size of the traveling-wave tube itself is substantially determined by specifications of the communication device that include the transmission frequency, transmission power, and power consumption.

SUMMARY OF THE INVENTION

It is an object of the present invention to provide an electron tube for communication that contributes to the reduction of the overall size and weight of a communication device that is provided with the electron tube for communication regardless of the specifications of the communication device.

An electron tube for communication such as a traveling-wave tube or klystron is typically provided with an output waveguide that is directly coupled to the outlet port of the RF signal. The output waveguide is a constituent element that is necessary for transmitting to the outside a RF signal that has been amplified by the electron tube for communication, and the output waveguide must be of a particular length depending on the layout of the communication device that includes the electron tube for communication.

In the present invention, attention is focused on the output waveguide that is provided in this electron tube for communication, this output waveguide being a construction that is provided with at least one of a low-pass filter, a high-pass filter, and a band-pass filter.

The electron tube for communication according to the description above allows a reduction of the constituent parts that are attached to the electron tube for communication. In addition, the provision of a filter in the output waveguide enables a reduction of noise outside the bandwidth that is not needed by the communication device.

The present invention can therefore realize a reduction in the size and weight of the overall communication device regardless of the specifications of the communication device that is provided with the electron tube for communication.

The above and other objects, features, and advantages of the present invention will become apparent from the following description with reference to the accompanying drawings, which illustrate examples of the present invention.

DETAILED DESCRIPTION OF THE PREFERRED EMBODIMENTS

Figure 1:
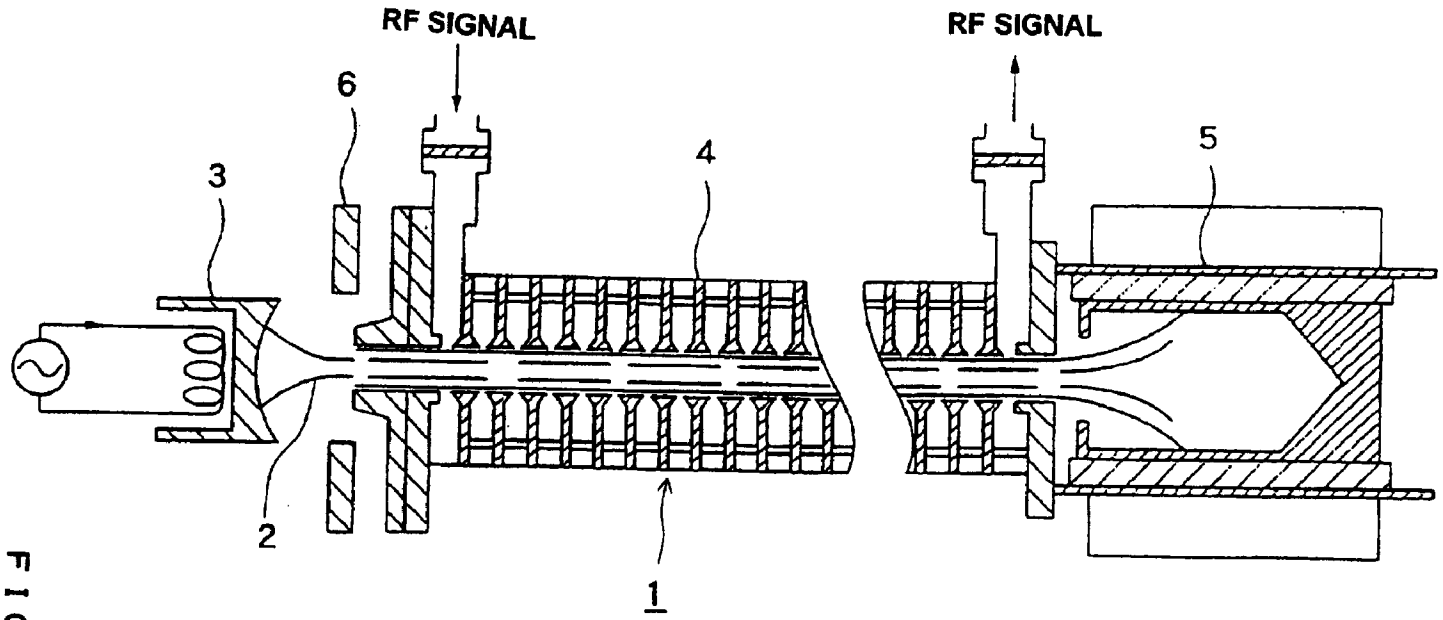
FIG. 1 (PRIOR ART)
FIG. 1 is a schematic view showing an example of the construction of a traveling-wave tube.
Figure 2:
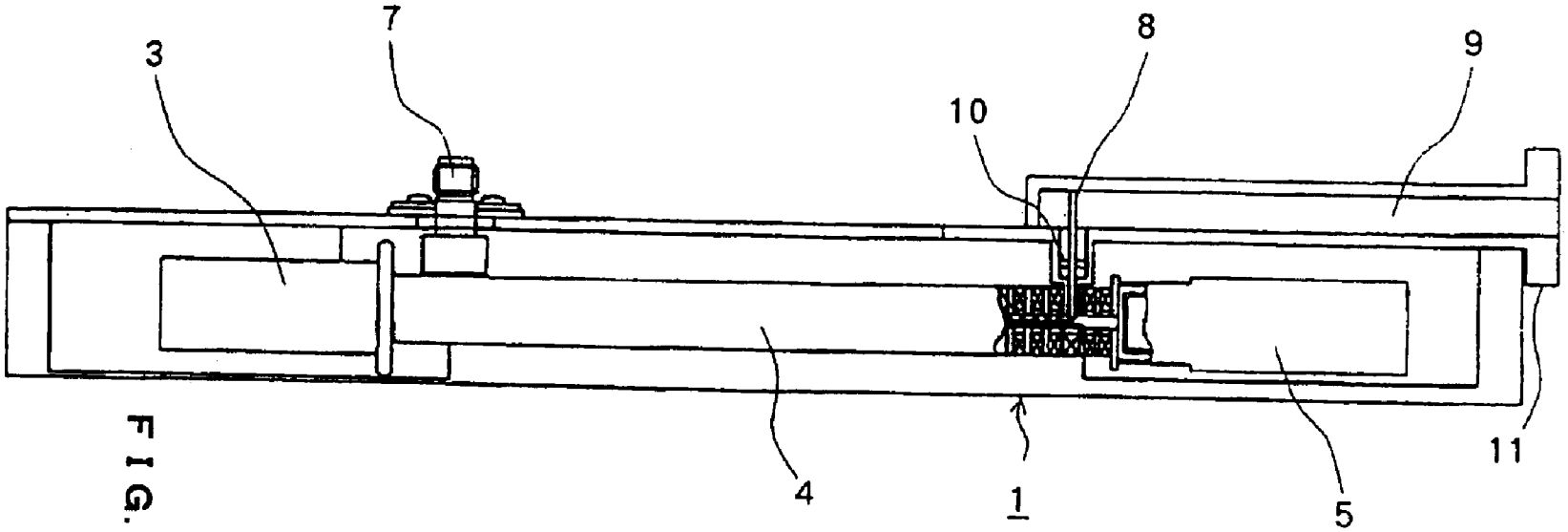
FIG. 2 (PRIOR ART)
FIG. 2 is a side sectional view showing the construction of the prior art of the traveling-wave tube that is shown in FIG. 1.
Figure 3:
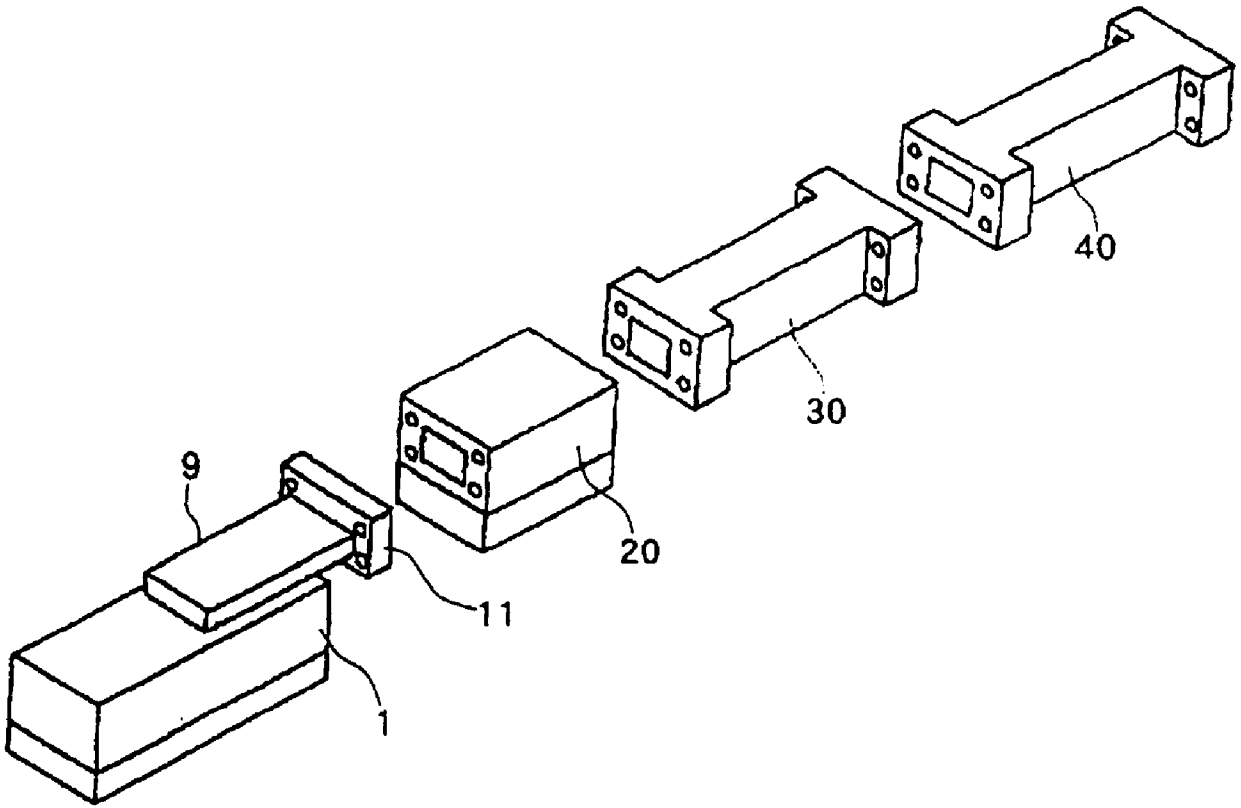
FIG. 3 (PRIOR ART)
FIG. 3 is a perspective view showing an example of the configuration of a circuit that is connected to the output waveguide that is shown in FIG. 2.
Figure 4:
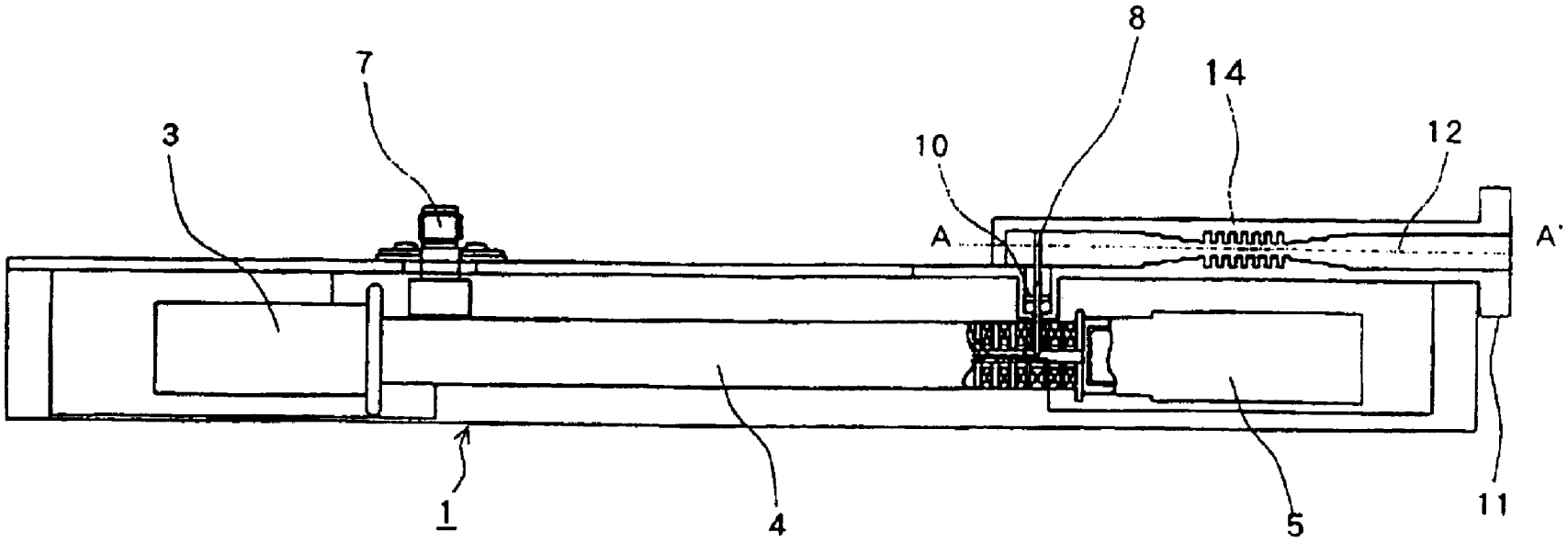
FIG. 4 is a side sectional view showing the construction of the electron tube for communication of the present invention.

As shown in FIG. 4, the electron tube for communication of the present invention is a construction that is provided with a filter circuit for RFs at least one of a low-pass filter, high-pass filter, or band-pass filter inside output waveguide 12, which is in turn directly coupled to the outlet port of a RF signal. The construction is otherwise identical to the construction of the prior art, and description regarding other aspects of the present invention is therefore omitted. FIG. 4 shows the construction of a traveling-wave tube similar to an electron tube for communication of the prior art that is shown in FIG. 2. In addition, constituent elements in FIG. 4 other than output waveguide 12 are identical to the construction of the prior art that is shown in FIG. 2, and these parts are therefore identified by the same reference numbers as are used in FIG. 2.

Output waveguide 12 is an indispensable constituent element for an electron tube for communication such as a traveling-wave tube or klystron and is used to transmit to the outside the RF signal that has been amplified by RF circuit 4. The length and the direction of coupling (the direction of flange 11) to other waveguides of output waveguide 12 are ideally designed according to the layout of the communication device that is provided with the traveling-wave tube 1.

The present invention allows a reduction in the number of components that are attached to the electron tube for communication by providing a filter circuit inside output waveguide 12, which conventionally has been used merely for transmitting RF signals to the outside.

In FIG. 4, a construction is shown in which a low-pass filter 14 is formed as a filter circuit in output waveguide 12, but a high-pass filter or band-pass filter may also be employed as the filter circuit. Further, although a construction is shown in FIG. 4 in which the direction of coupling of other waveguides to flange 11 is parallel to the direction of travel of the electron beam, a construction may also be employed in which another waveguide is joined in a direction that is orthogonal to the direction of travel of an electron beam.

Figure 5:
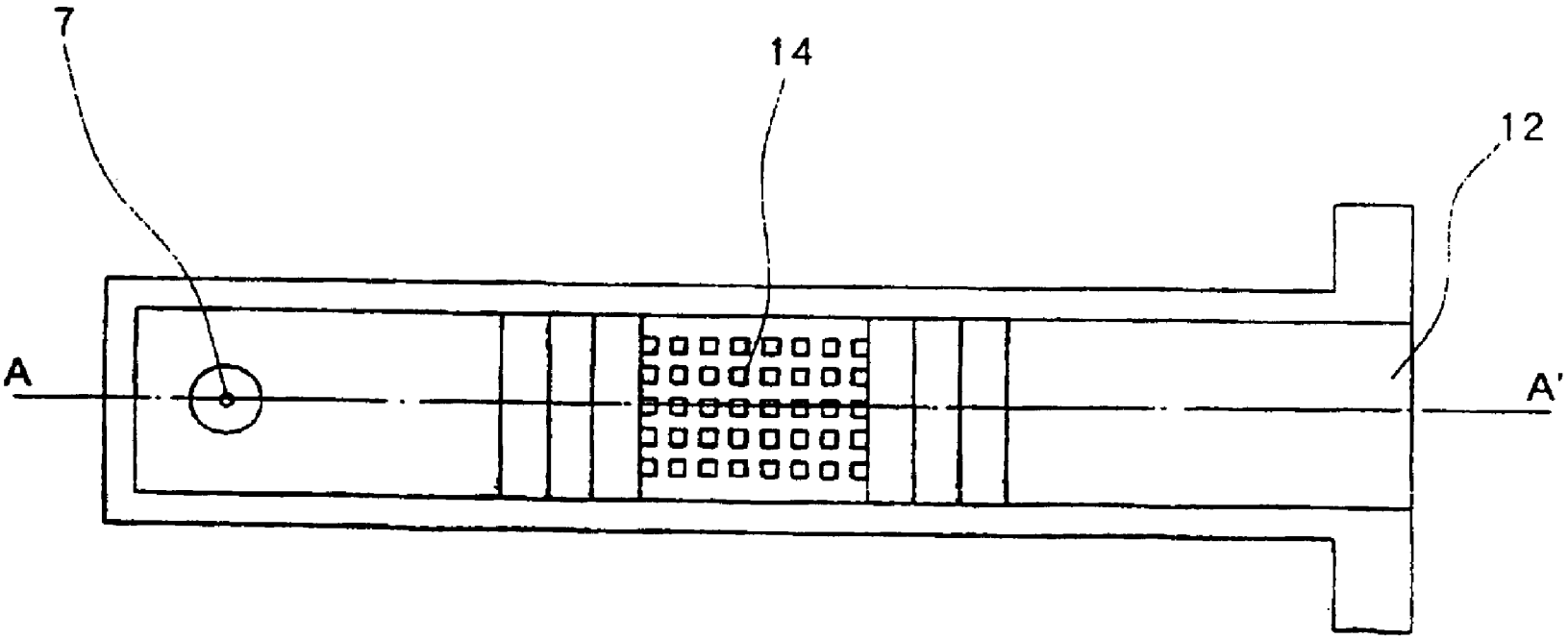
FIG. 5 is a sectional view taken along line A—A' of FIG. 4 showing an example of the construction of an output waveguide.

As shown in FIG. 5, a filter circuit known as a "waffle-iron filter" may be used as low-pass filter 14 that is provided inside output waveguide 12 of rectangle form.

A waffle-iron filter is a construction in which a plurality of corrugations is arranged in lattice form in the direction of propagation of a rectangular waveguide and in the longitudinal direction of a cross section of the rectangular waveguide that is orthogonal to the direction of propagation of the rectangular waveguide. These corrugations are arranged with a prescribed spacing that is determined by the maximum frequency (stop-band frequency) that can be propagated by the rectangular waveguide.

In a waffle-iron filter of this type of construction, of electromagnetic waves that have traveled in the TE (Transverse Electric)$_{10}$ mode, which is the basic propagation mode in the rectangular waveguide, electromagnetic waves of the stop-band frequency or lower are converted to the TEM (Transverse Electric and Magnetic) mode. Electromagnetic waves of the TEM mode are allowed to pass, while electromagnetic waves of frequencies that are higher than the stop-band frequency that have traveled in the $TE_{10}$ mode without alteration are reflected by the corrugations that are arranged in the direction of propagation. In other words, a waffle-iron filter transmits only electromagnetic waves of the stop-band frequency or lower that are converted to the TEM mode and thus functions as a low-pass filter.

Figure 6:
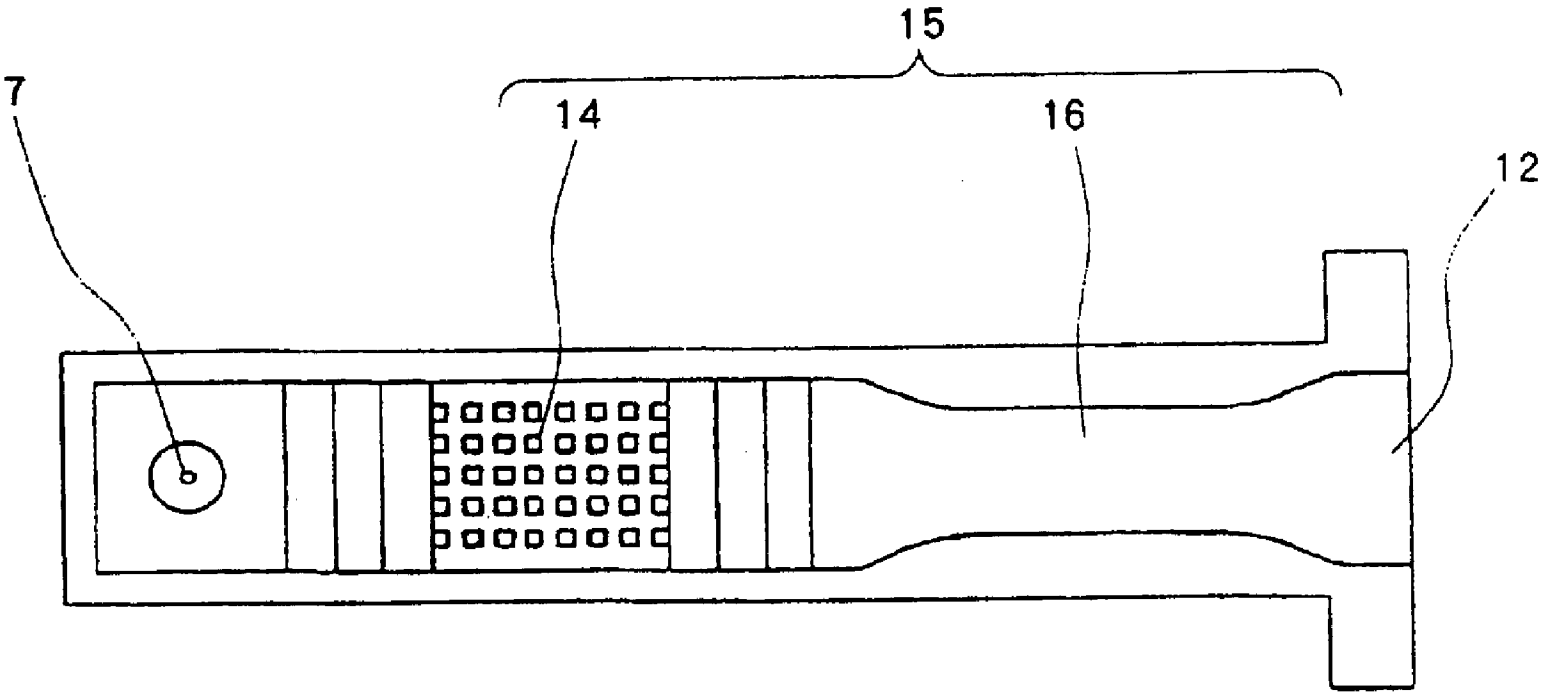
FIG. 6 is a sectional view showing another example of the construction of the output waveguide shown in FIG. 4.

On the other hand, a construction may be employed in which, for example, high-pass filter 16 and low-pass filter 14 that is shown in FIG. 5 are combined as band-pass filter 15 that is provided inside output waveguide 12, as shown in FIG. 6.

As shown in FIG. 6, high-pass filter 16 can be realized by forming a narrow region inside output waveguide 12 in the longitudinal direction of the waveguide cross section that is orthogonal to the direction of propagation in the waveguide. The cut-off frequency fc of this high-pass filter 16 can be expressed by the equation fc=c/2a, where a is the long side of the waveguide cross section that is orthogonal to the direction of propagation of output waveguide 12, and c is the velocity of light. However, fc in this case is the cut-off frequency for electromagnetic waves of the $TE_{10}$ mode.

The combination of high-pass filter 16 of this type and low-pass filter 14 that is shown in FIG. 5 enables the construction of band-pass filter 15 that transmits only electromagnetic waves within a desired bandwidth. In addition, it will be clear to one knowledgeable in the art that eliminating low-pass filter 14 from the construction that is shown in FIG. 6 will result in a construction that functions simply as high-pass filter 16.

While a preferred embodiment of the present invention has been described using specific terms, such description is for illustrative purposes only, and it is to be understood that changes and variations may be made without departing from the spirit or scope of the following claims.

What is claimed is:

1. An electron tube for communication that is provided with an output waveguide that is directly coupled to an outlet port to receive a Radio-Frequency signal, wherein said output waveguide includes at least one of a low-pass filter, a high-pass filter, and a band-pass filter, said output waveguide being arranged coaxially along an entire length of said output waveguide with said at least one of a low-pass filter, a high-pass filter, and a band-pass filter.

2. The electron tube for communication according to claim 1, wherein said low-pass filter is a waffle-iron filter having a plurality of corrugations that are arranged in a lattice pattern having prescribed spacing in the direction of propagation of said output waveguide and in the longitudinal direction of a cross section of the rectangular waveguide that is orthogonal to this direction of propagation.

3. The electron tube for communication according to claim 1, wherein said high-pass filter is constituted by forming a narrow region inside said output waveguide.

4. An electron tube for communication that is provided with an output waveguide directly coupled to an outlet port to receive a Radio-Frequency signal, wherein:

said output waveguide includes at least one of a low-pass filter, a high-pass filter, and a band-pass filter; and said band-pass filter includes:

a low-pass filter that is constructed from a waffle-iron filter having a plurality of corrugations that are arranged in a lattice pattern having a prescribed spacing in the direction of propagation of said output waveguide and in the longitudinal direction of a cross section of the rectangular waveguide that is orthogonal to this direction of propagation; and a high-pass filter that is formed by forming a narrow region inside said output waveguide.

5. An electron tube for communication comprising:

an amplifying section operative to amplify an input Radio-Frequency signal;

an inlet port operative to couple the input Radio-Frequency signal to the amplifying section;

an outlet port operative to receive the amplified Radio-Frequency signal from the amplifying section; and an output waveguide that is directly coupled to the outlet port, wherein said output waveguide includes at least one of a low-pass filter, a high-pass filter, and a band-pass filter, said output waveguide being arranged coaxially along an entire length of said output waveguide with said at least one of a low-pass filter, a high-pass filter, and a band-pass filter.

6. The electron tube for communication according to claim 5, wherein said low-pass filter is a waffle-iron filter having a plurality of corrugations that are arranged in a lattice pattern having prescribed spacing in the direction of propagation of said output waveguide and in the longitudinal direction of a cross section of the rectangular waveguide that is orthogonal to this direction of propagation.

7. The electron tube for communication according to claim 5, wherein said high-pass filter is constituted by forming a narrow region inside said output waveguide.

8. The electron tube for communication according to claim 5, wherein said band-pass filter is constituted by a low-pass filter in series with a high-pass filter.

* * * * *

UNITED STATES PATENT AND TRADEMARK OFFICE

CERTIFICATE OF CORRECTION

PATENT NO. : 7,088,060 B2
APPLICATION NO. : 10/701287
DATED : August 8, 2006
INVENTOR(S) : Yoshio Nakazato It is certified that error appears in the above-identified patent and that said Letters Patent is hereby corrected as shown below:

On Title Page Item [73] Insert
(73) Assignee: NEC Microwave Tube, Ltd.

Signed and Sealed this

Sixth Day of November, 2007

JON W. DUDAS
*Director of the United States Patent and Trademark Office*